US006280078B1

(12) United States Patent
Lewis

(10) Patent No.: US 6,280,078 B1
(45) Date of Patent: Aug. 28, 2001

(54) DOUBLE SIDED MIXING AND AERATING APPARATUS

(75) Inventor: Michael Anthony Lewis, Enoggera Queensland (AU)

(73) Assignee: TVA Technology Pty. Ltd. (AU)

( * ) Notice: Subject to any disclaimer, the term of this patent is extended or adjusted under 35 U.S.C. 154(b) by 0 days.

(21) Appl. No.: 09/486,028

(22) PCT Filed: Aug. 19, 1998

(86) PCT No.: PCT/AU98/00653

§ 371 Date: Feb. 18, 2000

§ 102(e) Date: Feb. 18, 2000

(87) PCT Pub. No.: WO99/08780

PCT Pub. Date: Feb. 25, 1999

(30) Foreign Application Priority Data

Aug. 30, 1997 (AU) ..... PO8817

(51) Int. Cl.[7] ..... B01F 7/26

(52) U.S. Cl. ..... 366/316; 366/265; 261/87; 261/93

(58) Field of Search ..... 366/262, 263, 366/265, 315–317; 261/83–85, 87, 91, 93; 416/90 R, 231 R, 231 A

(56) References Cited

U.S. PATENT DOCUMENTS

| | | | | |
|---|---|---|---|---|
| 2,609,189 | * | 9/1952 | Dering . | |
| 2,626,135 | * | 1/1953 | Serner . | |
| 3,273,865 | * | 9/1966 | White . | |
| 3,486,741 | * | 12/1969 | Midgette . | |
| 4,283,357 | * | 8/1981 | Sidery | 261/87 |
| 4,451,155 | * | 5/1984 | Weber et al. | 366/265 |
| 5,085,810 | | 2/1992 | Burrows . | |
| 5,318,360 | * | 6/1994 | Langer et al. | 366/317 |

FOREIGN PATENT DOCUMENTS

| | | |
|---|---|---|
| 0 006 597 A1 | 1/1980 | (EP) . |
| 6597 | 1/1980 | (EP) . |
| 0 256 965 A2 | 2/1988 | (EP) . |
| 0 434 124 A1 | 6/1991 | (EP) . |
| 2 113 562 | 8/1983 | (GB) . |
| 2 143 443 | 2/1985 | (GB) . |
| WO94/26402 | 11/1994 | (WO) . |
| WO97/30292 | 8/1997 | (WO) . |

OTHER PUBLICATIONS

SU 1572–689 A (Agric Mechn Electr Res) Jun. 23, 1990.
Chemical Engineering, Week 9118, p. 16.
SU 860–847 (LATV Marine Fleet) Sep. 7, 1981.
Chemical Engineering, Week E26, p. 13.
Derwent Abstract Accession No. 80227Y/45.
Class D15J01, J52115778 (Arait), Sep. 28, 1977.

* cited by examiner

*Primary Examiner*—Charles E. Cooley
(74) *Attorney, Agent, or Firm*—Cantor Colburn LLP

(57) ABSTRACT

A mixing apparatus comprising a central disc driven by a rotating shaft. A number of mixing plates are stacked above and/or below the central disc. The mixing plates are spaced from and parallel to the central disc. Each plate has a central aperture and the diameter of the central aperture increases progressively away from the central disc to define a space coaxial with the rotating shaft. In operation, fluid is drawn into the space and directed out through the space between the plates. When placed near the surface of a fluid, air is drawn in and the fluid is aerated as well as mixed.

13 Claims, 9 Drawing Sheets

DOUBLE SIDED MIXING AND AERATING APPARATUS

FIELD OF THE INVENTION

This invention relates to the field of mixing and aeration. In particular, an improved mixing apparatus is described that can also provide aeration.

BACKGROUND OF THE INVENTION

Efficient mixing of dissimilar fluids, or fluids and solids, is required in many situations including chemical processing, sewerage treatment, waste water aeration, etc. Mixing is typically achieved by rotating blades or impellers that physically displace the fluid thereby causing agitation that leads to mixing. The efficiency of this process is strongly dependent upon the design of the mixing blades and the nature of the components to be mixed.

U.S. Pat. No. 5,344,235 assigned to General Signal Corporation describes an improved impellor blade having an airfoil shape. The blade is coated with an erosion resistant material to overcome the problem of the blade deteriorating through use due to the impact with solids being mixed. The General Signal Corp patent is indicative of the general state of the art of impellor based mixers and aerators.

In assessing the prior art reference may be made to U.S. Pat. No. 4,865,459 assigned to Chuorika Co Ltd. This patent describes a mixer comprising a rotating disc mounted on a shaft a small distance from a fixed disc. A propeller is mounted on the end of the shaft for drawing in liquid which is forced through apertures in the rotating disc to be engaged by shear forces between the fixed and rotating discs. The shear forces between the discs is said to produce effective and uniform mixing.

Reference may also be made to U.S. Pat. No. 4,267,051 assigned to Rheintech Weiland. This patent describes an aerator comprising a group of parallel plates rotated near the surface of a liquid by a horizontal shaft. A rectangular cavity in the periphery of each disc traps air and forces it below the liquid level as the discs rotate. Trapping air and releasing it below the surface of liquid is known to be of only moderate efficiency for increasing oxygen content in the liquid. Although this device is likely to be more efficient than simply bubbling air through liquid, the improvement is likely to be small.

A more efficient aerator is described in French patent number 1580389 assigned to Societe Parisienne. This patent describes a hollow spindle having mounted at one end an air distributor comprising two parallel discs separated by four plates. A helix is mounted on the spindle above the air distributor to draw air into the apparatus for distribution through the liquid. Although this device would manage to force air into the liquid, bubbles will form and move immediately to the surface, thereby minimising the achievable benefit.

Despite the wide range of mixing apparatus designs and the extensive activity directed to improvements in aerators and mixers, there is still room for considerable improvement.

OBJECT OF THE INVENTION

It is an object of the present invention to provide an improved mixing apparatus. It is another object of the present invention to provide an improved aeration apparatus. Further objects will be evident from the following description.

DISCLOSURE OF THE INVENTION

In one form, although it need not be the only, or indeed the broadest form, the invention resides in an improved mixing apparatus comprising: a rotating shaft;

a central disc mounted coaxial to a lower part of the shaft; and a plurality of mixing plates mounted coaxial with the shaft, said mixing plates spaced from and parallel to the central disc;

each said mixing plate including a central aperture;

wherein the central apertures of the plurality of mixing plates together define one or more spaces having an apex at the central disc and a base at an outermost mixing plate furthermost from the central disc.

There may be mixing plates mounted above, below or both sides of the central disc.

A plurality of spacers are suitably disposed adjacent the mixing plates to space the mixing plates from one another and from the central disc In preference, each central aperture has a diameter and the diameters increase progressively from the mixing plate nearest the central disc to the outermost mixing plate so as to define the space in a shape of a cone There are suitably between two and ten mixing plates above the central disc and between two and ten mixing plates below the central disc. Most suitably there are six mixing plates above the central disc and four mixing plates below the central disc.

Preferably the cone is formed at an angle of between twenty degrees and eighty degrees relative to an axis of the shaft. Most preferably the cone is formed at an angle of thirty degrees relative to an axis of the shaft.

In one form, the shaft is hollow and communicates with channels formed in the central disc, said channels providing communication between the hollow central shaft and an outer periphery of the central disc.

BRIEF DETAILS OF THE DRAWINGS

To assist in understanding the invention preferred embodiments will now be described with reference to the following figures in which.

Figure 5:
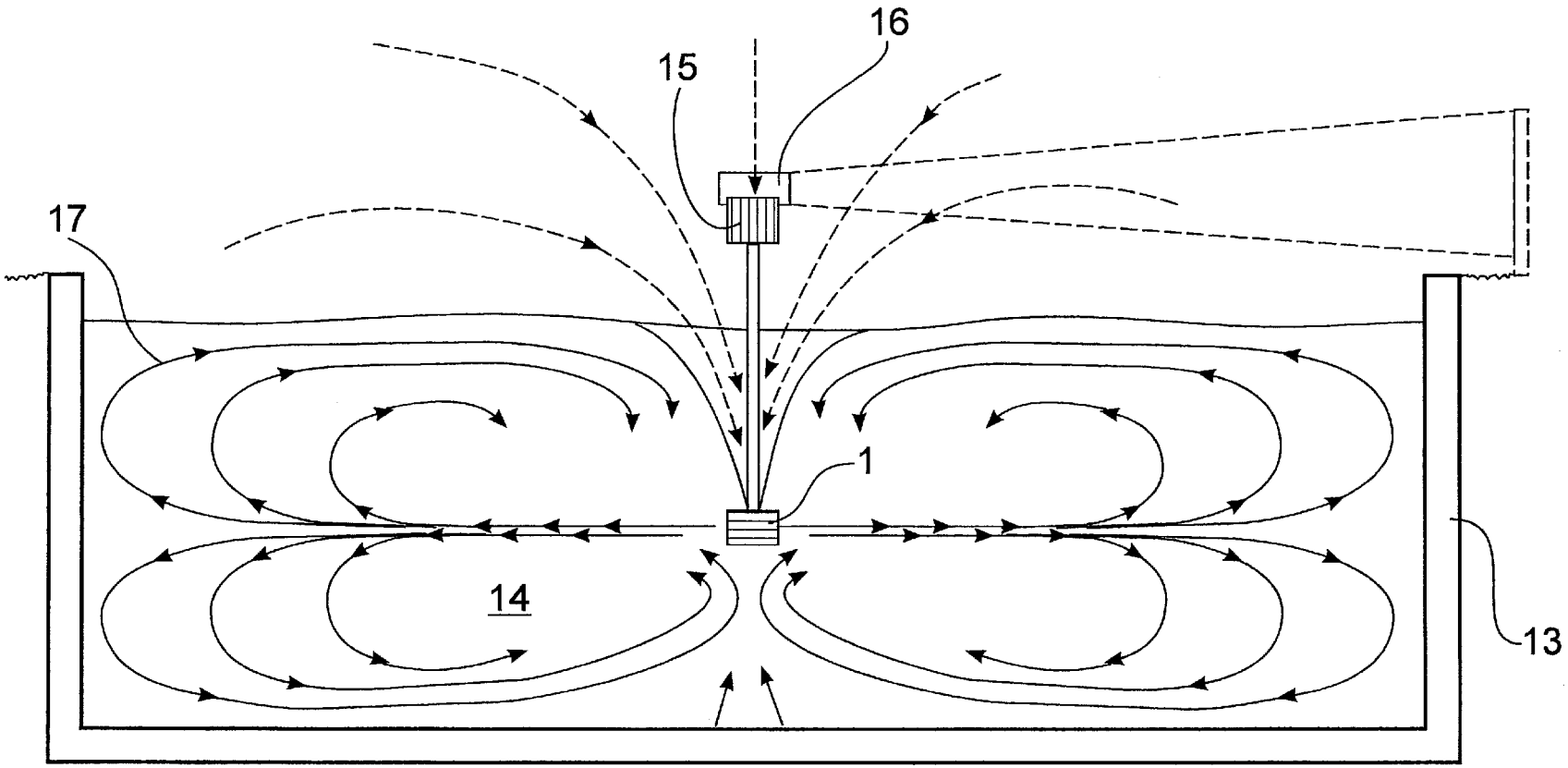
Figure 6:
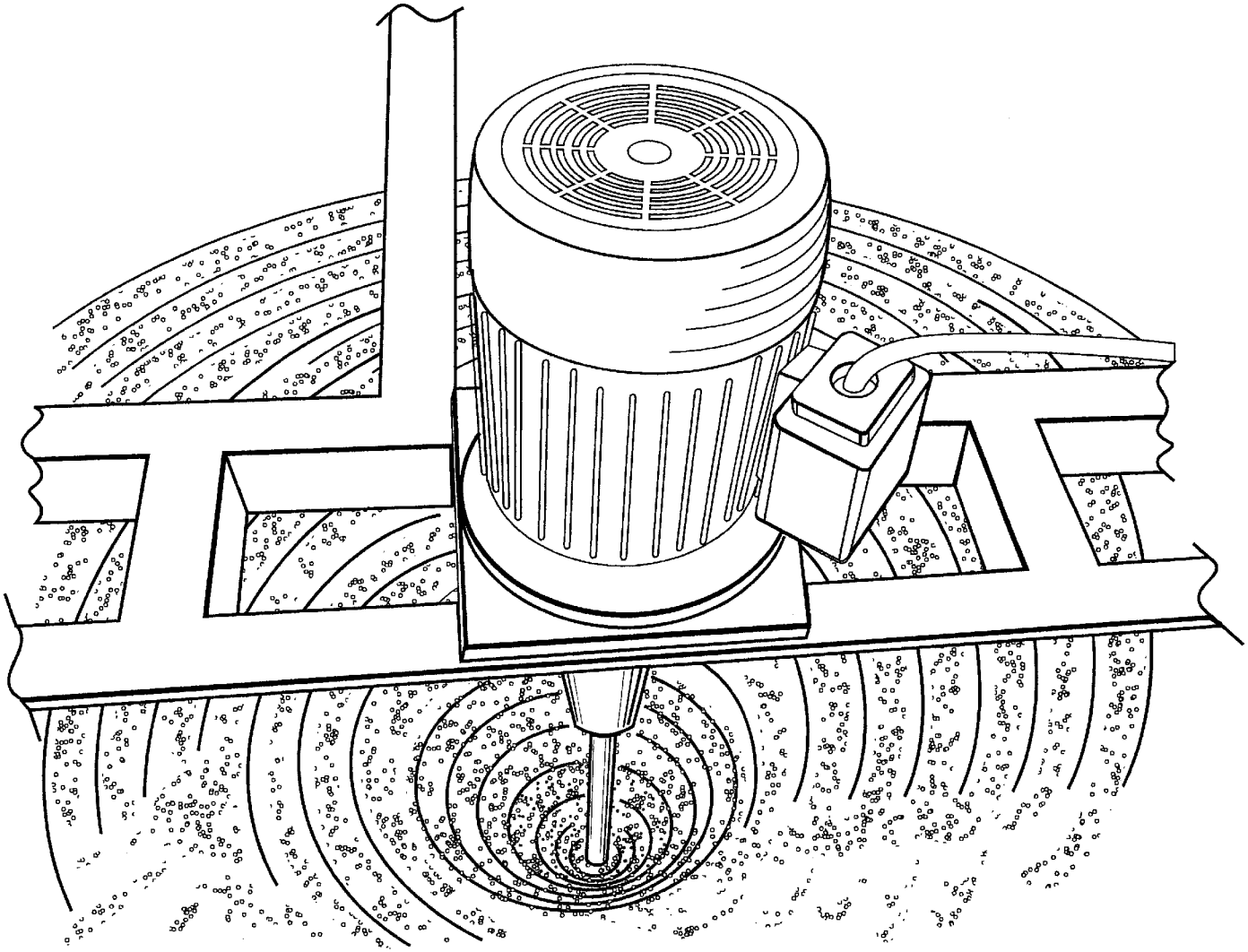
Figure 7:
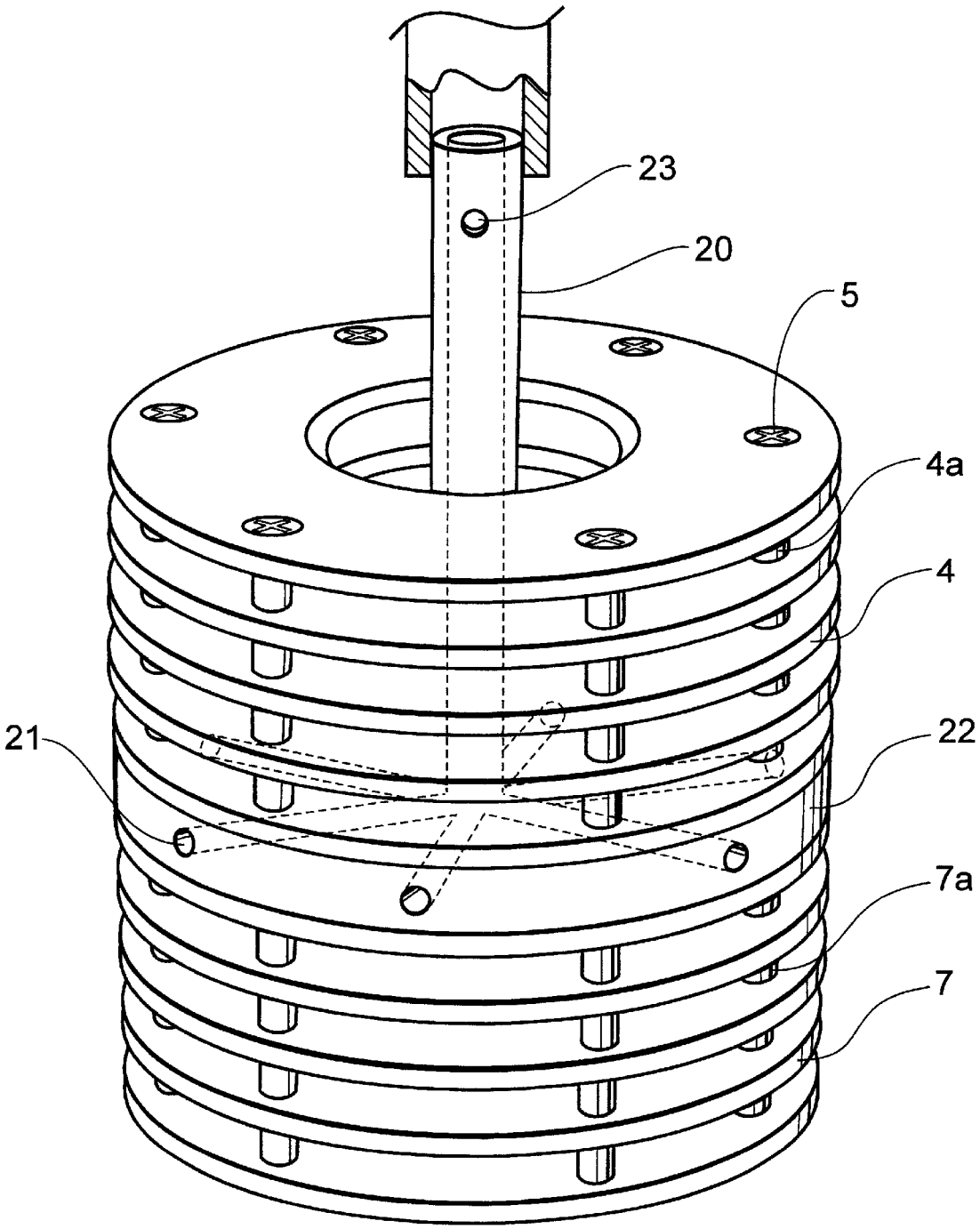
Figure 8:
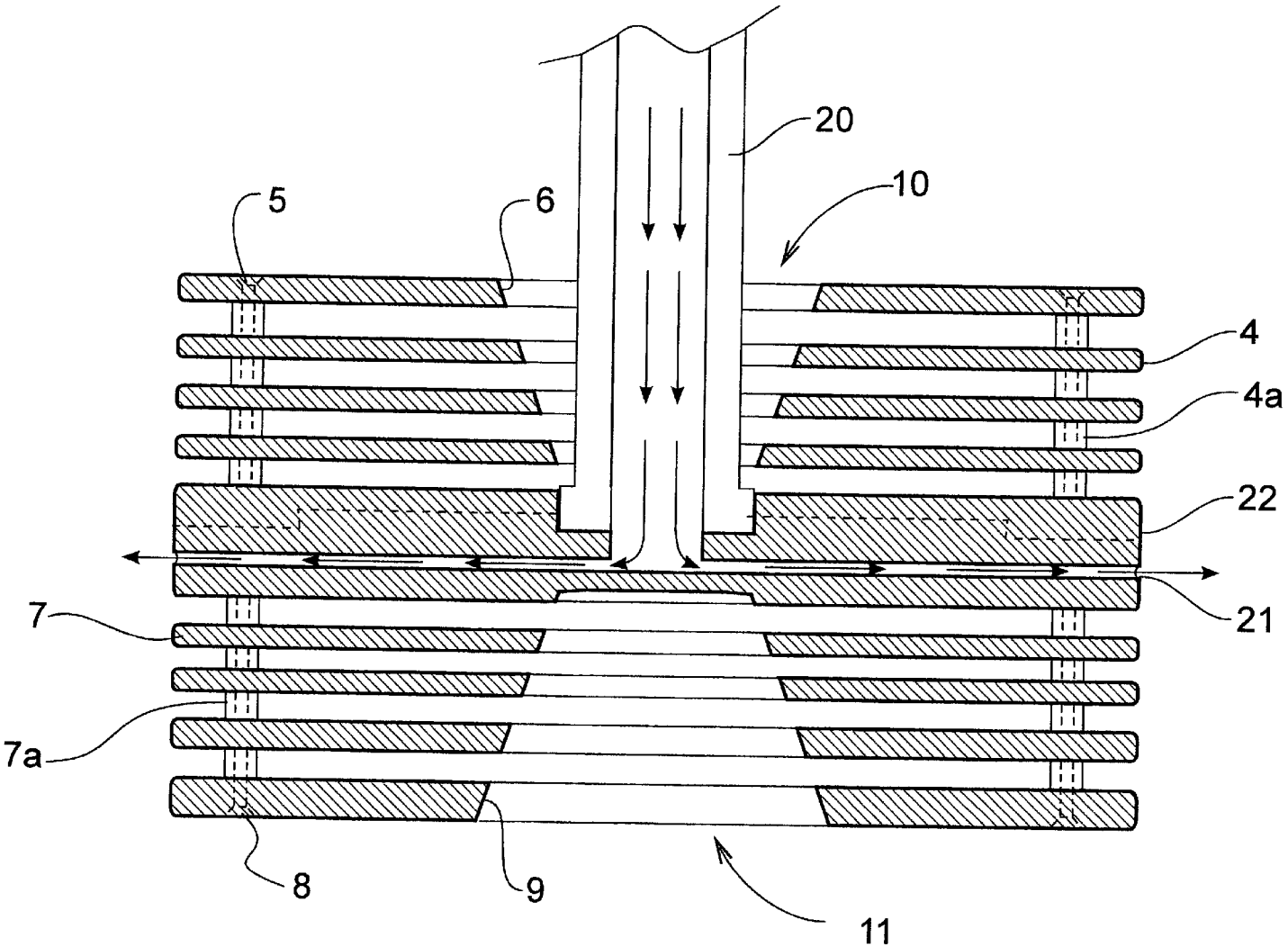
Figure 9:
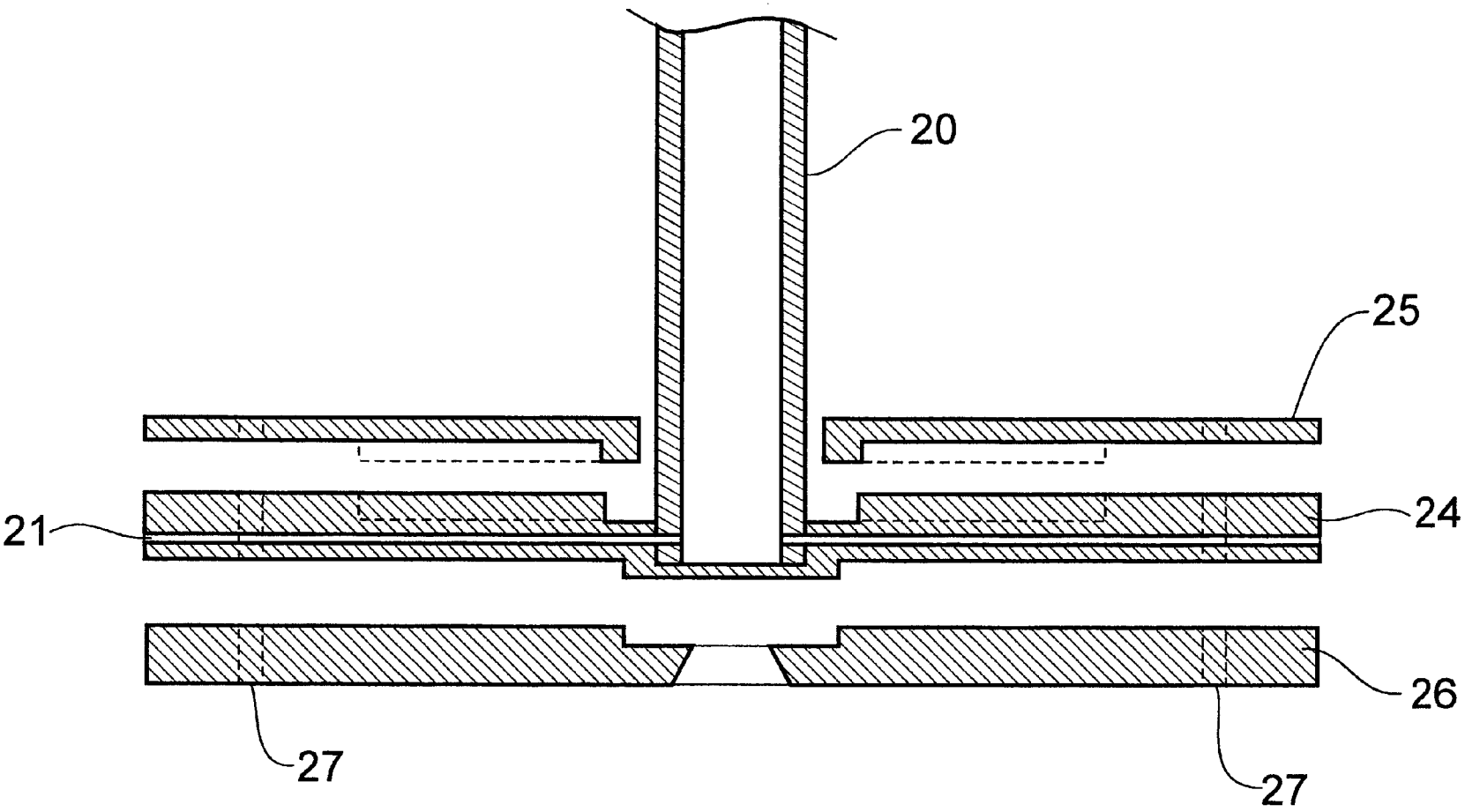
Figure 10:
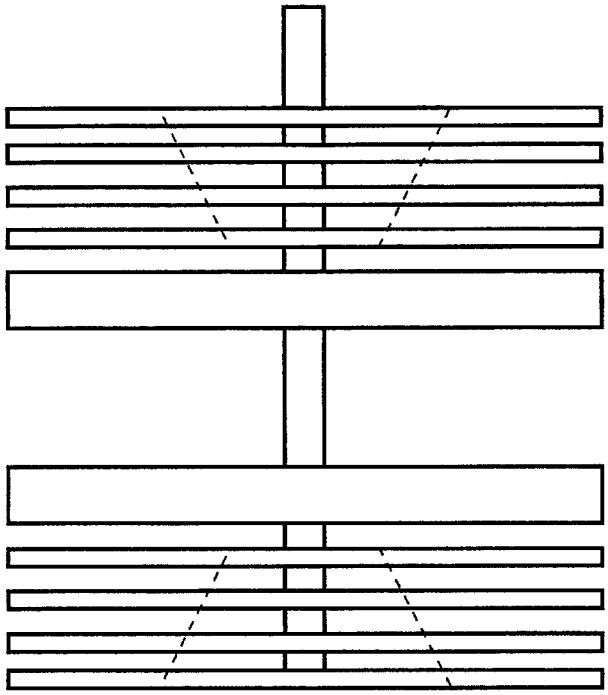

FIG. 5 indicates the flow of fluid during operation of the apparatus;

FIG. 6 shows the third embodiment in operation;

FIG. 7 shows a fourth embodiment of a mixing apparatus;

FIG. 8 shows a side cross-section view of the fourth embodiment;

FIG. 9 shows one embodiment of the central disk;

FIG. 10 is a sketch of a fifth embodiment of a mixing apparatus; and

Figure 11:
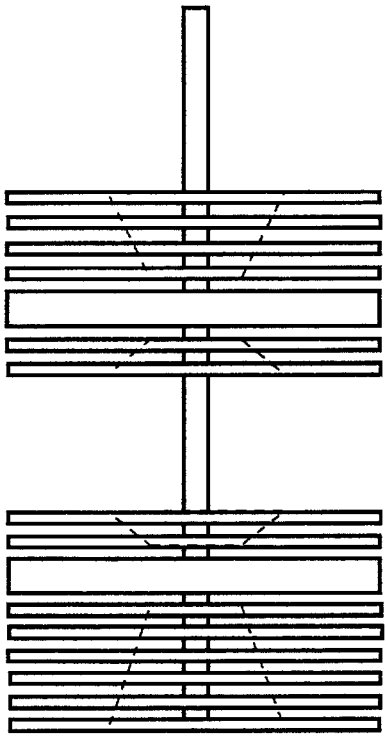

FIG. 11 is a sketch of a sixth embodiment of a mixing apparatus.

DETAILED DESCRIPTION OF THE DRAWINGS

Figure 1:
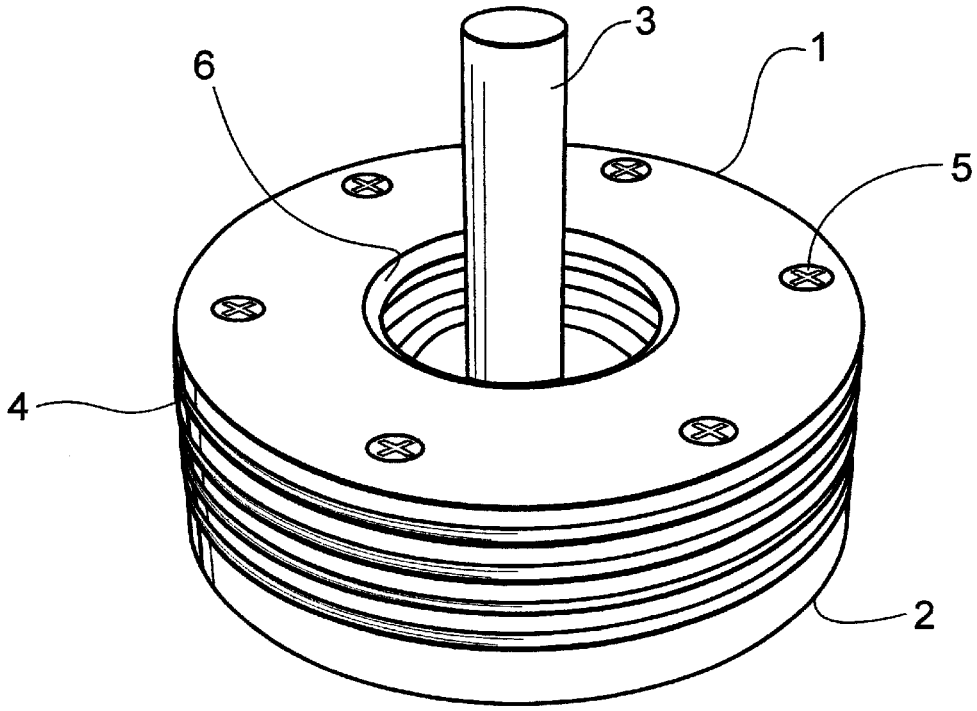
FIG. 1 shows a sketch of a first embodiment of a mixing apparatus.

Referring to FIG. 1, there is shown a first embodiment of a mixing apparatus generally indicated as 1. The mixing apparatus 1 comprises a central disc 2 connected to the lower end of a rotating shaft 3. The rotating shaft 3 is driven by a motor (not shown) at an upper end.

A number of mixing plates, such as 4, are mounted concentric to the shaft 3 and parallel to the central disc 2. The central disc 2 and mixing plates 4 are assembled on rods 5. Each rod is threaded at one end to allow the rod to be screwed into the central disc 2 and has a head at the other end to capture the mixing plate. Clearly the rod can be inverted so that it screws into the top mixing plate with the head capturing the central disc.

Figure 4:
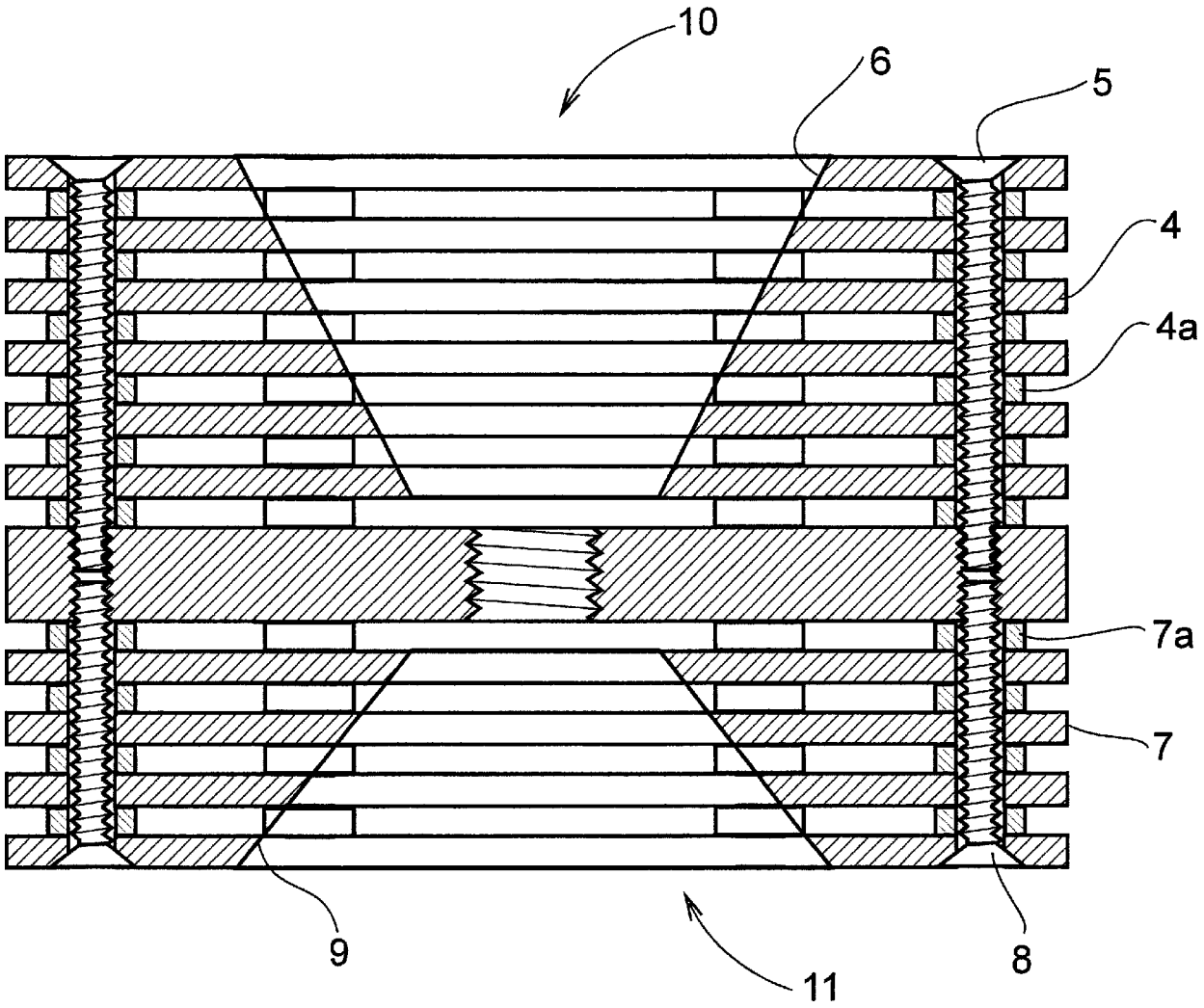
FIG. 4 shows a side cross-section view of the third embodiment.

The mixing plates 4 are evenly spaced on the rods by spacers 4*a* (such as shown in FIG. 4) placed on the rods. In the preferred embodiments the spacers are all the same size so that the mixing plates are evenly spaced. Even spacing is not essential to the operation of the invention. The inventor envisages that in certain applications there may be advantage in progressively increasing or decreasing the spacing between the plates.

Each mixing plate 4 has a central hole 6. The diameter of the hole 6 in each plate 4 is different. The plates 4 are arranged so that the holes 6 are arranged to form an upper cone closed at the central disc and open towards the top plate. The angle of the upper cone relative to the central axis of the shaft 3 may be in the range 20 degrees to 80 degrees but the inventor has found that an angle of 30 degrees is most suitable. In operation, the rotation of the mixing apparatus draws fluid down through the upper cone and out through the spaces between the plates. The operation is explained in greater detail with reference to FIG. 5.

Figure 2:
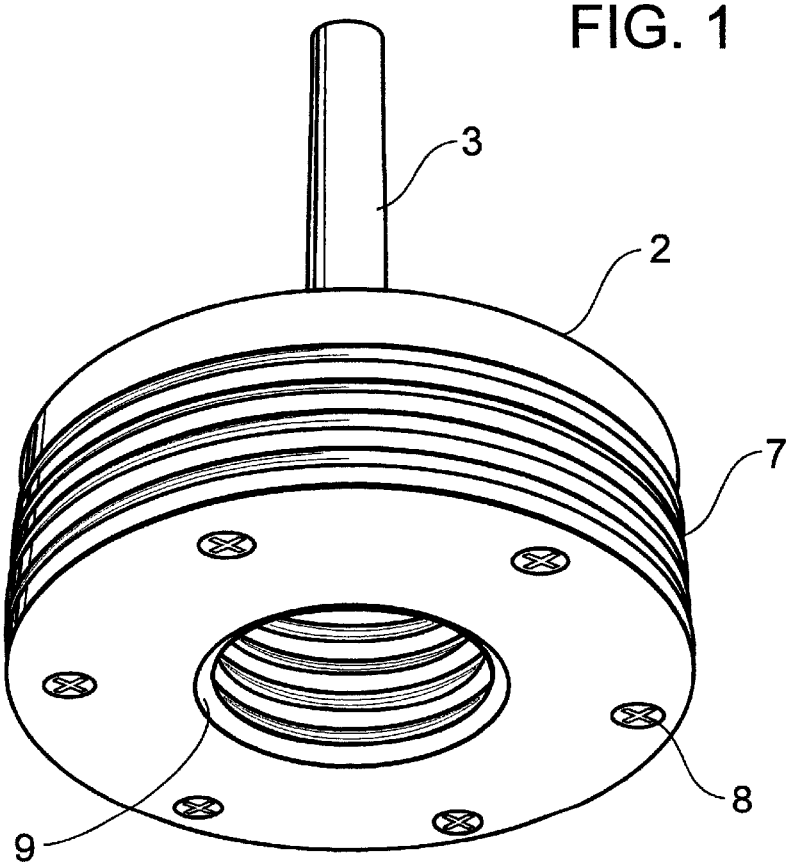
FIG. 2 shows a sketch of a second embodiment of a mixing apparatus.

A second embodiment of a mixing apparatus is shown in FIG. 2. The second embodiment is similar to the first embodiment but with the components inverted. As with the first embodiment a central disc 2 is mounted at the lower end of a shaft 3. A number of mixing plates 7 are attached below the central disc 2 by rods 8 and spaced apart by spacers 7*a* (shown in FIG. 4) mounted on the rods.

Although the spacers 4*a*, 7*a* are shown as separate from the plates 4, 7, it will be appreciated that they could be formed integrally with the plates.

Central holes 9 in the mixing plates 7 form a lower cone closed at the central disc and open towards the bottom plate. Rotation of the mixing apparatus draws fluid up through the bottom plate and out through the spaces between the plates.

Figure 3:
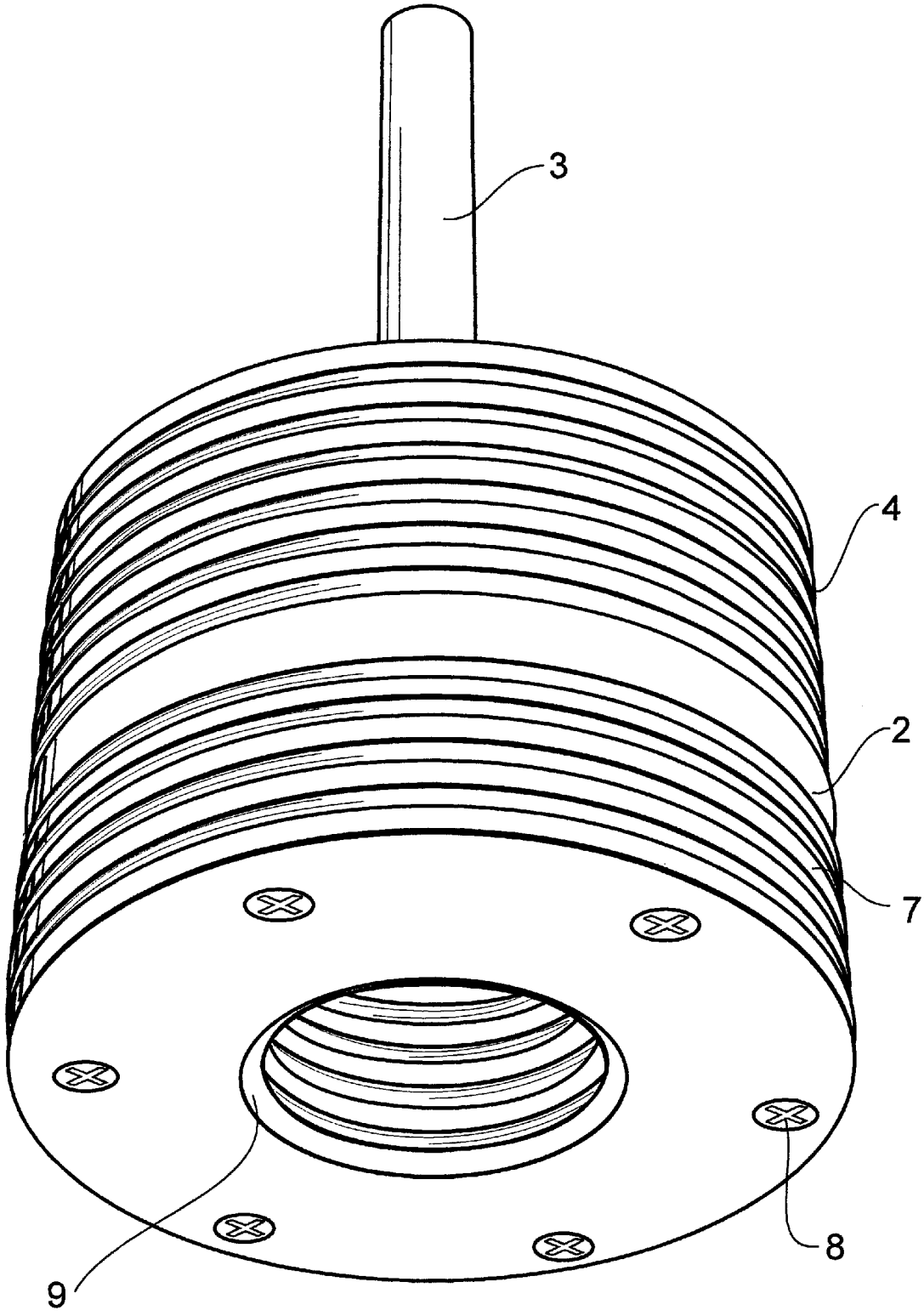
FIG. 3 shows a perspective view of a third embodiment of a mixing apparatus from below.

The inventor has found that best mixing is achieved with the third embodiment shown in FIG. 3. The third embodiment is a combination of the first embodiment of FIG. 1 and the second embodiment of FIG. 2. As previously described, a central disc 2 is fixed to the lower end of the shaft 3. In the third embodiment, six mixing plates 4 are stacked above the central disc and four mixing plates 7 are stacked below the central disc. Each mixing plate has a central hole with the diameter of the hole reducing towards the central disc so that a cone is formed above and below the central disc.

The structure of the mixing apparatus of the third embodiment is seen most clearly in FIG. 4. As can be seen in the figure, the rods 5 and 8 screw into the central disc 2 to hold the mixing plates 4, 7 in parallel spaced relation to the central disc. The diameters of the holes 6, 9 progressively decrease towards the central disc to form an upper cone 10 and a lower cone 11. The threaded hole 12 in the central disc 2 receives a threaded end of the shaft.

In operation, fluid is drawn into the upper cone 10 and lower cone 11 and dispersed through the spaces between the mixing plates. The flow of fluid during operation of the mixing apparatus is shown schematically in FIG. 5. In FIG. 5 the mixing apparatus 1 is shown suspended in a tank 13 filled with fluid 14. The mixing apparatus 1 is driven by a motor 15 which is supported by a frame 16. A typical motor might be a two horsepower electric motor rotating at 1440 rpm.

As shown by the flow lines 17, fluid is drawn in through the cones and dispersed out through the spaces between the mixing plates. If the mixing apparatus is suspended close to the surface of the fluid a vortex will form and air will be drawn into the upper cone and dispersed through the spaces between the upper mixing plates. The inventor has found that, when operated in this manner, the mixing apparatus is a very efficient aerator. A mixing apparatus formed from 150 mm plates, with six plates above the central disc and four plates below, and 30 degree cones in the upper and lower plates, when driven by a 2 horsepower electric motor at 1440 rpm has been effective in killing algae in a small dam through aeration of the water.

In a further example of the operation of the mixing apparatus, an apparatus formed from 250 mm plates, with six plates above the central disc and four plates below, 30 degree cones in the upper and lower plates, driven by a 10 horsepower electric motor at 1440 rpm, and suspended 400 mm below the surface of a tank of 3500 liters, was effective in mixing the contents of the tank in about 20 seconds. The operation of the mixing apparatus in this application is shown in FIG. 6.

The inventor speculates that the effectiveness of the mixing apparatus is, at least in part, due to the operation of the vortex formed in the cones. Fluid at the entry of the vortex will rotate at or near the velocity of rotation of the mixing apparatus. However, as the fluid is drawn into the cone the narrowing imparts an acceleration so the velocity increases significantly. The accelerated fluid is thrown into the surrounding fluid causing massive agitation and therefore effective mixing.

Similarly, when the mixing apparatus is positioned close to the surface of a liquid, air is drawn down the cone and accelerated. The accelerated air is thrown into the surrounding liquid causing massive aeration and turbulence.

The inventor has found that a fluid boundary layer forms on the spinning mixing apparatus. This has the unexpected benefit of making the mixing apparatus completely safe to touch during operation. The boundary layer provides an effective barrier between the mixing apparatus and the environment. In fact, it is possible to place a hand upon the apparatus during operation with absolutely no injury being caused.

To enhance aeration of the fluid being mixed the inventor has devised the fourth embodiment shown in FIG. 7. As with the earlier embodiments the mixing apparatus consists of a number of plates spaced above and below a central disc. A cone is formed in the stacked plates by forming holes in the plates of progressively reducing diameter. However, in the fourth embodiment the shaft 20 is hollow and connects to a number of channels 21 in the central disc 22. The shaft 20 has one or more apertures 23 in an upper part of the hollow shaft. In operation, air is drawn down the shaft and forced out through the channels 21.

The flow of air in the fourth embodiment is depicted in FIG. 8. The inventor envisages that the fourth embodiment could find particular application where deep aeration is required, such as in a lake or other water storage. If the mixing apparatus is positioned deep in the lake to achieve deep mixing it would not be possible for air to be drawn into the upper vortex so air would be drawn down through the hollow shaft instead.

One suitable structure for the central disc 22 of the fourth embodiment is shown in FIG. 9. The central disc 22 is made from three separate components. A middle plate 24 is threaded to the shaft 20 and has channels 21 formed therein. An upper plate 25 is clamped to the middle plate 24 to form a connection between the shaft and the central disc that disperses the stress associated with the initial start up of the mixing apparatus. A strengthening plate 26 is located below the upper and middle plates. The rods 5, 8 are screwed into threaded holes 27 in the strengthening plate to complete assembly of the fourth embodiment of the mixing apparatus.

A fifth embodiment of the invention is shown in FIG. 10. In FIG. 10 there are two mixing apparatuses connected to a common shaft. At an upper end is attached a mixing apparatus according the first embodiment of FIG. 1. Further down the shaft a mixing apparatus according to the second embodiment of FIG. 2 is attached. The embodiment of FIG. 10 is useful for relatively deep fluids in which aeration is required (and provided by the upper mixing apparatus) as well as deep mixing (provided by the lower mixing apparatus.

In a sixth embodiment, shown in FIG. 11, two mixing apparatuses according to FIG. 3 are attached to a common shaft. The separation between the two mixing apparatuses is chosen to suit the depth of the fluid to be mixed. The inventor conceives that the sixth embodiment will find particular application in deep fluids requiring intensive mixing.

Apart from the applications discussed above, the mixing apparatus is useful for dispersing powder in a fluid to form a suspension. For example, materials mixed or suspended in water have included lime, surfactants, blood and oil. In preliminary tests the mixing apparatus has been found to be more effective than traditional mixers. It has also been found that fumes associated with some mixing are reduced when the mixing apparatus is used. The inventor speculates that this is due to released fumes being entrained during the mixing process. The fumes may be oxidised or dissolved.

In another application, waste water has been treated by aerobic breakdown of contaminants. The efficiency of aerobic breakdown of contaminants is dependent upon microbes being able to make surface contact with decomposing material. In conventional mixers, heavy particles settle to the bottom of the treatment pond and become anaerobic. The mixing apparatus not only introduces large volumes of air into the waste water but also draws particles up from the bottom of the pond. in this application it is important that the spacing between mixing plates is greater than the maximum size of the largest particle.

The inventor has found that the mixing apparatus can suitably be made from plastics material attached to a metal shaft. However, construction is not limited to plastics material so other material, such as stainless steel, is also suitable. In fact, in aggressive environments plastics may not be suitable.

It will be appreciated from the above description that the mixing apparatus does not rely upon surface contact with the fluid in the manner provided by prior art impellor and blade mixers. Rather, the vortexial action generated by the cone in the rotating mixing plates causes extensive fluid flow producing substantially homogeneous mixing. Although useful for anaerobic mixing, the mixing apparatus finds best application when positioned near the surface of a fluid to be mixed. The upper cone forms a vortex that draws air into the fluid for aerobic mixing.

Throughout the specification the aim has been to describe the invention and not to limit the invention to any particular combination of features or components. Variations will be evident to persons skilled in the art which do not depart from the spirit of the invention.

What is claimed is:

1. A mixing apparatus comprising:

a rotating shaft;

a central disc mounted coaxial to a lower part of the shaft; and a plurality of mixing plates positioned on each side of the central disc and mounted coaxial with the shaft, said mixing plates spaced from and parallel to the central disc;

each said mixing plate including a central aperture;

wherein the central apertures of the plurality of mixing plates together define one or more spaces having an apex at the central disc and a base at an outermost mixing plate furthermost from the central disc.

2. The mixing apparatus of claim 1 further comprising a plurality of spacers disposed adjacent the mixing plates to space said mixing plates from one another and from the central disc.

3. The mixing apparatus of claim 1 wherein each central aperture has a diameter and the diameters increase progressively from the mixing plate nearest the central disc to the outermost mixing plate so as to define said one or more spaces in a shape of a cone.

4. The mixing apparatus of claim 3 where in the cone is formed at an angle of between twenty degrees and eighty degrees relative to an axis of the shaft.

5. The mixing apparatus of claim 3 wherein the cone is formed at an angle of thirty degrees relative to an axis of the shaft.

6. The mixing apparatus of claim 1 having between two and ten mixing plates mounted on one side of the central disc.

7. The mixing apparatus of claim 1 having between two and ten mixing plates mounted each side of the central disc.

8. The mixing apparatus of claim 1 wherein the shaft is hollow and communicates with channels formed in the central disc, said channels providing communication between the hollow central shaft and an outer periphery of the central disc.

9. A mixing apparatus comprising:

a rotating shaft;

a central disc mounted coaxial to a lower part of the shaft;

a plurality of upper mixing plates mounted above the central disc and coaxial with the shaft, said upper mixing plates spaced from and parallel to the central disc and each said upper mixing plate including a central aperture; wherein the central apertures of the plurality of upper mixing plates together define an upper space having an apex at the central disc and a base at an upper mixing plate furthermost from the central disc; and a plurality of lower mixing plates mounted below the central disc and coaxial with the shaft, said lower mixing plates spaced from and parallel to the central disc and each said lower mixing plate including a central aperture; wherein the central apertures of the plurality of lower mixing plates together define a lower space having an apex at the central disc and a base at a lower mixing plate furthermost from the central disc.

10. The mixing apparatus of claim 9 having between two and ten upper mixing plates and between two and ten lower mixing plates below the central disc.

11. The mixing apparatus of claim 9 wherein each central aperture has a diameter and the diameters increase progressively from the mixing plates nearest the central disc to the outermost mixing plates so as to define the lower and upper spaces each in a shape of a cone.

12. The mixing apparatus of claim 11 wherein the cone is formed at an angle of thirty degrees relative to an axis of the shaft.

13. A mixing apparatus comprising:

a rotating shaft;

a central disc mounted coaxial to a lower part of the shaft; and a plurality of mixing plates positioned on each side of the central disc and mounted coaxial with the shaft, said mixing plates spaced from and parallel to the central disc;

each said mixing plate including a central aperture;

wherein the central apertures of the plurality of mixing plates together define one or more spaces having an apex at the central disc and a base at an outermost mixing plate furthermost from the central disc; and wherein said shaft is selectively rotatable to allow rotation of the central disc and the mixing plates to produce a turbulent flow.

* * * * *